US009844718B2

(12) United States Patent
Ferrel et al.

(10) Patent No.: US 9,844,718 B2
(45) Date of Patent: Dec. 19, 2017

(54) INTERCHANGEABLE DRIVE PLATES FOR SNOWBOARD BINDINGS

(71) Applicant: Mervin Manufacturing, Inc., Seattle, WA (US)

(72) Inventors: Paul Ferrel, Seattle, WA (US); Dain Engebretsen, Seattle, WA (US); Steven Cobb, Seattle, WA (US); Ryan Smith, Seattle, WA (US)

(73) Assignee: Mervin Manufacturing, Inc., Seattle, WA (US)

( * ) Notice: Subject to any disclaimer, the term of this patent is extended or adjusted under 35 U.S.C. 154(b) by 0 days.

(21) Appl. No.: 14/887,180

(22) Filed: Oct. 19, 2015

(65) Prior Publication Data

US 2017/0106269 A1 Apr. 20, 2017

(51) Int. Cl.

*A63C 10/28* (2012.01)
*A63C 10/00* (2012.01)
*A63C 10/04* (2012.01)

(52) U.S. Cl.

CPC ..... *A63C 10/28* (2013.01); *A63C 10/00* (2013.01); *A63C 10/285* (2013.01); *A63C 10/04* (2013.01)

(58) Field of Classification Search

CPC ..... A63C 9/086; A63C 10/14; A63C 10/28
See application file for complete search history.

(56) References Cited

U.S. PATENT DOCUMENTS 5,765,853 A 6/1998 Erb
5,845,421 A 12/1998 Tanaka
7,309,077 B2 * 12/2007 Couderc ..... A63C 10/285 280/14.22
8,056,436 B2 11/2011 Marable et al.
8,104,786 B2 1/2012 Fumagalli
(Continued)

FOREIGN PATENT DOCUMENTS

CH 678397 A5 9/1991
EP 1368098 A2 12/2003
(Continued)

OTHER PUBLICATIONS

"Adjustment Is Better", https://www.unionbindingcompany.com/technology/true-fit, Accessed Mar. 26, 2015, 3 Pages.
"Men's Genesis EST Snowboard Binding—Burton Snowboard", http://www.burton.com/default/genesis-est-snowboard-binding/W15-105631.html, Accessed Mar. 26, 2015, 4 Pages.
(Continued)

*Primary Examiner* — John Walters
*Assistant Examiner* — James Triggs
(74) *Attorney, Agent, or Firm* — Lowe Graham Jones PLLC

(57) ABSTRACT

A snowboard binding includes a baseplate configured to secure to an upper surface of a snowboard a high back and straps secure to the baseplate. A drive plate is secured to the upper surface of the baseplate and has a stiffness effective to change ride properties of the snowboard. The drive plate may include a laminate structure including one or more composite layers such as fiberglass, carbon fiber, aluminum, or titanium. A carriage may mount the drive plate to the snowboard and may define a recess for receiving the drive plate. Tabs may extend from the lower surface of the carriage and engage corresponding apertures in the baseplate. The tabs may have hooked end portions to secure the carriage to the baseplate.

15 Claims, 6 Drawing Sheets

(56) References Cited

U.S. PATENT DOCUMENTS

| | | | | |
|---|---|---|---|---|
| 8,770,595 | B2 | 7/2014 | Cruikshank et al. | |
| 2002/0088146 | A1* | 7/2002 | Joseph | A43B 5/04 36/117.3 |
| 2003/0164605 | A1 | 9/2003 | Maravetz et al. | |
| 2007/0029459 | A1 | 2/2007 | Hanson | |
| 2007/0138766 | A1 | 6/2007 | Couderc | |
| 2007/0200317 | A1* | 8/2007 | Ellison | A43B 5/0401 280/623 |
| 2014/0151981 | A1 | 6/2014 | Berthet et al. | |
| 2014/0157627 | A1 | 6/2014 | Smaldone et al. | |

FOREIGN PATENT DOCUMENTS

| | | | |
|---|---|---|---|
| EP | 1508352 | A1 | 2/2005 |
| EP | 2644234 | A1 | 2/2013 |
| KR | 20000060267 | A | 10/2000 |
| WO | 2008008261 | A2 | 1/2008 |

OTHER PUBLICATIONS

"Salomon Mirage Snowboard Bindings—Women's 2016", http://www.evo.com/snowboard-bindings/salomon-mirage-womens.aspx, Accessed Mar. 26, 2015, 3 Pages.

Dionne, Mark, "NOW 2015 Snowboard Bindings", http://www.neverboredinc.com/blog-neverbored-blog/bid/395575/NOW-2015-Snowboard-Bindings, Accessed Mar. 26, 2015. 7 Pages.

"Union Ultra Snowboard Bindings 2016", http://www.evo.com/snowboard-bindings/union-ultra.aspx, Accessed Mar. 26, 2015, 3 Pages.

International Search Report; dated Oct. 26, 2016; 6 Pages.

* cited by examiner

INTERCHANGEABLE DRIVE PLATES FOR SNOWBOARD BINDINGS

FIELD OF THE INVENTION

This application relates to the field of snowboard bindings.

BACKGROUND OF THE INVENTION

Snowboarding encompasses many different styles of riding. Some may use a "freestyle" snowboard to ride a half pipe, jumps, and other terrain features. Others may use a "freeride" snowboard for backcountry snowboarding and long descents. Still others may use a powder board for riding in fresh snow. Each style of board will have unique dimensions to suit a style of riding. Likewise, each style of board will have different flexural properties. However, despite the many styles of boards and the various lengths and widths available, they do not remotely approach the diversity of the riders that will use them. Riders come in different shapes and sizes and all have different riding styles and preferences. Even during a given day of riding a rider may switch to a different board as the riding conditions change.

Accordingly, it would be an advancement in the art to provide means for tuning a snowboard's ride properties to suit each rider and the riding conditions.

SUMMARY OF THE INVENTION

In one aspect of the invention, a snowboard binding includes a baseplate having an upper surface and a lower surface opposite the upper surface, the baseplate configured to secure to an upper surface of a snowboard, the plate having the lower surface facing the upper surface of the snowboard. A boot engagement member is secured to the baseplate and configured to secure the boot within the snowboard binding. A drive plate is secured to the upper or lower surface of the baseplate and has a stiffness effective to change flex properties of the binding for changing the driving interface between the rider (i.e., snowboard boot) and the snowboard.

In another aspect of the invention, the drive plate further includes a flex plate and a carriage to hold the flex plate, the carriage including a plurality of first fastening elements configured to mount the carriage to the baseplate and a plurality of second fastening elements configured to mount the carriage to the flex plate. In some embodiments, the flex plate receiver defines a recess on a first surface thereof and a plurality of tabs protruding from a second surface of the receiver opposite the first surface. The baseplate may define a plurality of tab receivers each positioned to receive one of the tabs of the plurality of tabs. The tabs and recesses between the receiver and the baseplate may be reversed such that the other has the tabs.

In another aspect of the invention, the plurality of tabs include one or more first tabs each including a first hooked end portion extending in a first direction and one or more second tabs including a second hooked end portion extending in a second direction opposite the first direction. In some embodiments, the first hooked end portion of each of the one or more first tabs extends toward the one or more second tabs.

In another aspect of the invention, the flex plate includes a laminate including one or more composite layers, such as fiberglass or carbon fiber.

In another aspect of the invention, the baseplate includes a circular opening with a toothed perimeter, the drive plate occluding the circular opening. The boot engagement member may further include a highback and at least one strap configured to secure a boot to the baseplate. The baseplate may further include two flanges extending outwardly from the upper surface, the highback and the at least one strap being mounted to the flanges and the baseplate being positioned between the flanges.

A corresponding method of use is also disclosed and claimed herein.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1A:
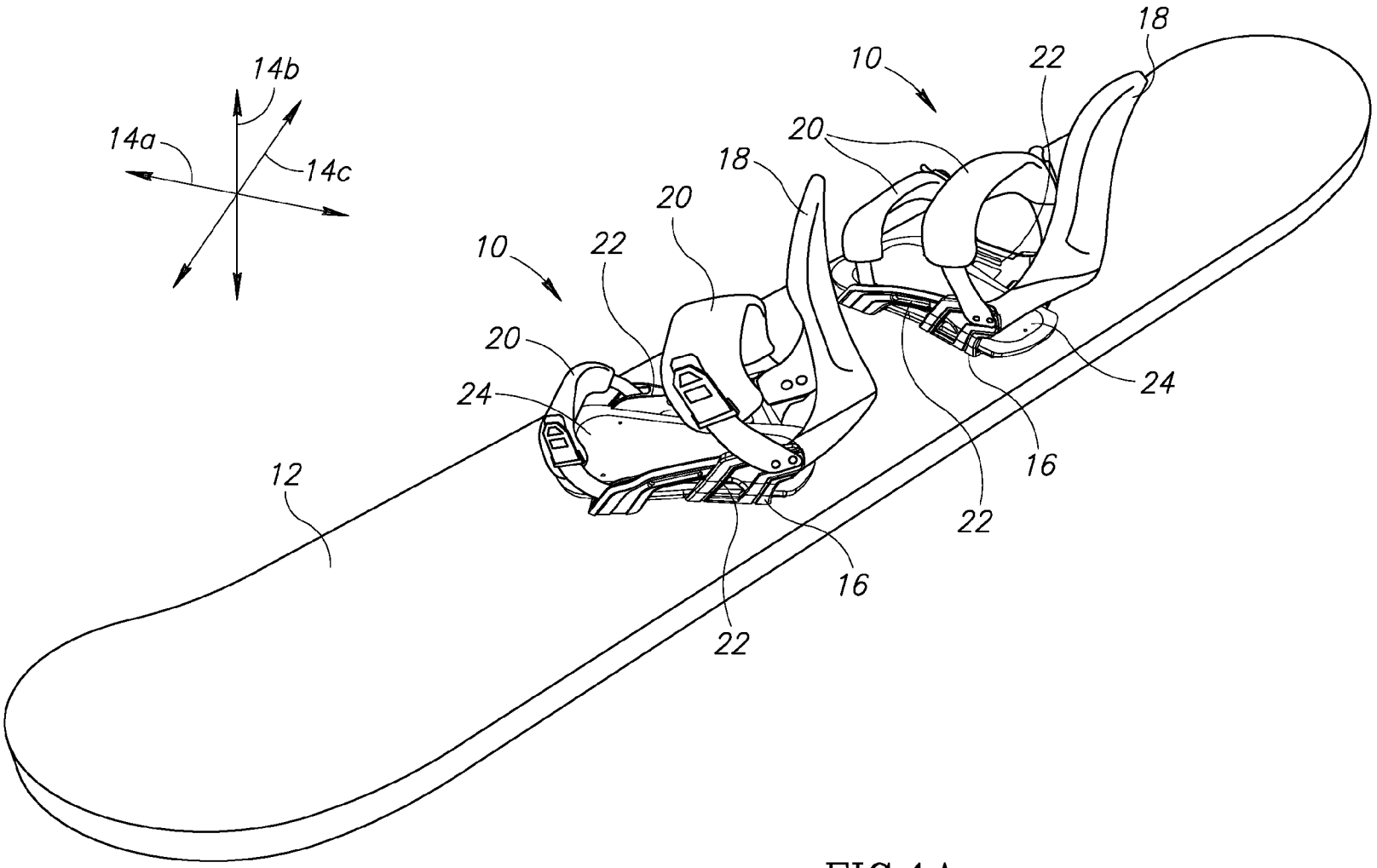
FIGS. 1A and 1B are isometric views of a snowboard having bindings secured thereto in accordance with an embodiment of the present invention.
Figure 1B:
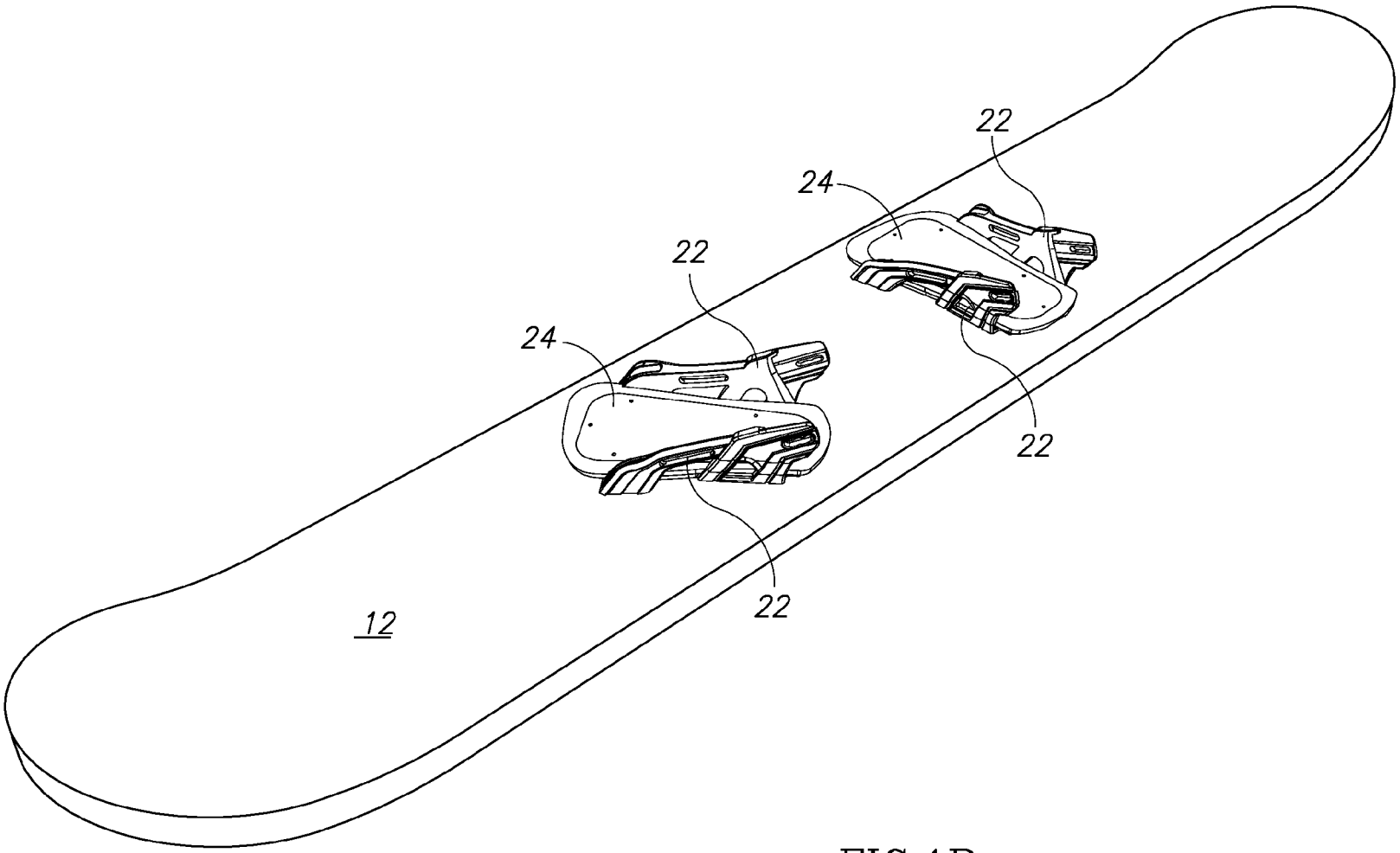

Referring to FIGS. 1A and 1B, snowboard bindings 10 may mount to a snowboard 12. The placement of the bindings 10 may vary according to user preference but generally have a longitudinal axis 14*a* of the binding oriented generally perpendicular to the long dimension of the snowboard 12. As is apparent in FIGS. 1A and 1B, the binding on the right is generally perpendicular whereas the binding on the left is angled relative to perpendicular. Such positioning is set according to rider preference, including the angles of the bindings with respect to the board as well as the distance between the bindings and the proximity of the bindings to a toe-side edge or a heel-side edge of the board. The bindings 10 may be identical to one another or be mirrored relative to one another. Accordingly, the bindings illustrated herein may be understood to be suitable for a left or right binding with suitable mirroring.

Each binding 10 may define a longitudinal direction 14*a*, generally corresponding to the long dimension of a wearer's foot or boot inserted therein. A vertical direction 14*b* is defined as perpendicular to the longitudinal direction 14*a* and oriented generally vertically when the snowboard 12 is positioned on a flat surface. A lateral direction 14*c* may be defined as perpendicular to both the longitudinal and vertical directions 14*a*, 14*b*.

Each binding 10 may include a baseplate 16 for securing to the snowboard 12. The baseplate 16 may define any conventional mounting interface for securing the binding 10. Structures for securing a boot to the snowboard 12 may secure to the baseplate 16. For example, a highback 18 and straps 20 may mount to the baseplate 16 in the conventional manner. In the illustrated embodiment, the baseplate 16 defines flanges 22 extending along the longitudinal direction 14*a* and offset from one another along the lateral direction 14*c*. The highback 18 and straps 20 pivotally mount to the flanges 22 and a wearer's boot seats between the flanges 22 when secured to the binding 10.

A drive plate, made up of a flex plate 24 and a carriage 26, mounts to the baseplate 16. In some embodiments, the carriage and flex plate may be integrated to form a single piece drive plate. In the illustrated embodiment, the flex plate 24 mounts above the baseplate 16 in the vertical direction 14*b* such that baseplate 16 is between the snowboard 12 and the flex plate 24 along the vertical direction 14*b*.

The flex plate 24 may include a laminate structure similar to a laminate structure used to form snowboards. Specifically, the layers of the flex plate 24 may be stacked along the vertical direction 14*b* and each layer may extend in a plane perpendicular to the vertical direction 14*b*. For example, the flex plate 24 may include one or more layers of composite material such as fiberglass or carbon fiber. The flex plate 24 may alternatively include layers of wood or plywood, a top protective layer made of plastic (such as a polyethylene or polyurethane) or other material, a foam or honeycombed core layer, or other layers known in the art to be used to construct a snowboard 12. For example, metal sheets may be used in a layer in a composite flex plate or as the entire flex plate. Aluminum and titanium are examples of preferred metals.

The layers included in the flex plate 24 and the thickness thereof may vary. In particular, many different types of drive plates may be used and exchanged for one another in engagement with the baseplate 16. In particular, the flexural strength of the flex plates 24 may vary such that a user may vary the ride qualities of the snowboard 12 by changing the drive plate. The flexural properties of the flex plate 24 are preferably such that securement of the drive plate to the baseplate 16 substantially and perceptibly alters the ride quality of the combined snowboard 12 and bindings 10. Such may occur by changing the bending stiffness and/or torsional stiffness of the binding and, by connection, the snowboard as well. Relative to a standard snowboard binding base, the flex plate 24 may result in a softer or stiffer binding and board overall, depending on the flex plate used. A softer plate may be desired in some conditions and for some riders, such as for soft snow and/or light riders. A stiffer plate may be desired in some conditions and for some riders, such as for more aggressive riding in mixed snow. Park riders may desire less edge bight in some instances, while carvers on hard pack snow may wish to increase edge grip.

In some embodiments, rods or panels made of metal or composite material (e.g., fiberglass or carbon fiber) may insert within corresponding holes, e.g. holes extending in the longitudinal or lateral directions 14*a*, 14*c*, in order to tune the flexural properties of the drive plate. For example, a user may add or remove rods or panels in order to make the drive plate more or less stiff, respectively.

Figure 2A:
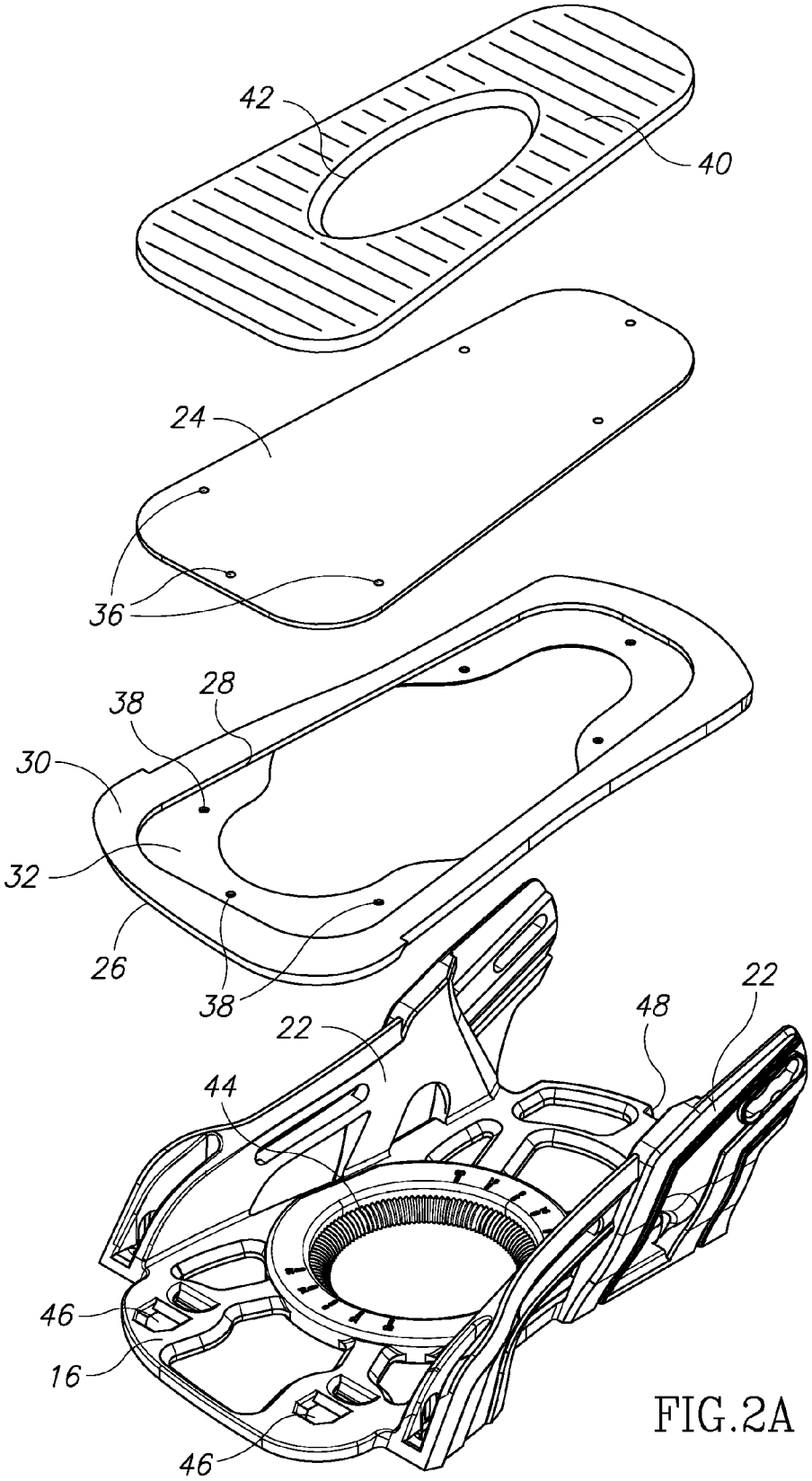
FIGS. 2A and 2B are exploded views of a snowboard binding in accordance with an embodiment of the present invention.
Figure 2B:
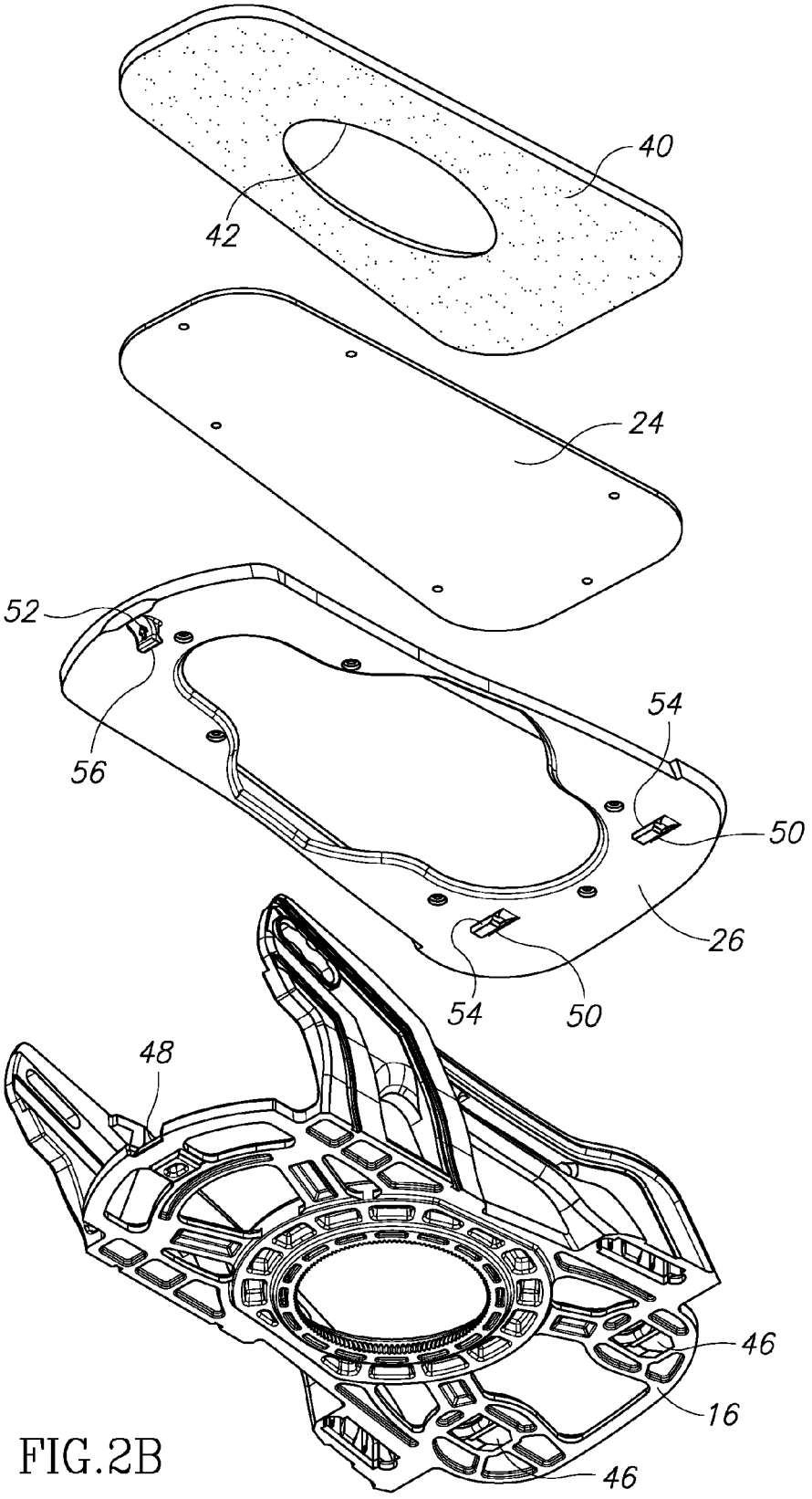

Referring to FIGS. 2A and 2B, the flex plate 24 may secure to the baseplate 16 by means of a carriage 26. The carriage 26 may be made of rigid plastic and may cooperate with the rigidity of the drive plate to alter the ride properties of the combined bindings 10 and snowboard 12. Alternatively, the carriage 26 may not significantly contribute to any modification of ride properties.

In the illustrated embodiment, the carriage defines a recess 28 with an outer rim 30 of material extending outwardly from the recess 28 and the perimeter of a flex plate 24 secured within the recess 28. A seating surface 32 at the bottom of the recess 28 may define an opening 34 in order to reduce the weight of the carriage 26. The flex plate 24 may mount to the carriage 26 by means of fasteners such as screws. Accordingly, the flex plate 24 may define openings 36 and the carriage 26 may define openings 38 for receiving screws. Alternatively, the flex plate 24 may secure to the carriage 26 by means of an adhesive applied to the seating surface 32. In use, the flex plate 24 may remain secured to the carriage 26, i.e. where multiple drive plates with multiple properties are used, each flex plate 24 may have its own carriage 26 to which it remains secured.

In some embodiments, a pad 40 secures to the flex plate 24 and/or the carriage 26. For example, the flex plate 24 may be sandwiched between the pad 40 and the carriage 26. Thus, the drive plate is made up of the pad 40, the flex plate 24, and the carriage 26. The carriage 26 may include a flexible rubber or elastomer and may be ribbed or otherwise textured to prevent slippage of a boot placed thereon. In some embodiments, the flex plate 24 may include graphics visible on the upper and/or lower surface thereof similar to graphics commonly included on the upper or lower surface of a snowboard. Accordingly, the pad 40 may define an opening 42 such that these graphics are at least partially visible.

As is apparent in FIGS. 2A and 2B, the flex plate 24 and carriage 26 may be positioned between the flanges 22. The baseplate 16 may define an indexed opening 44, i.e. a ring of teeth, for receiving a similarly indexed disc fastened to the snowboard in order to secure the baseplate 16 to the snowboard at a user-selectable position as known in the art. The flex plate 24 may cover this opening 44 when secured to the baseplate 16.

In some embodiments, the baseplate 16 may include one or more forward tab receivers 46 and one or more rearward tab receivers 48. In the illustrated embodiment, there are two forward tab receivers 46 and one rearward tab receivers 48, but other configurations may also be used. The forward tab receivers 46 may be closer to a toe end of the baseplate 16 than the rearward tab receivers and the rearward tab receivers 48 may be closer to the heel end of the baseplate 16 than the forward tab receivers.

A lower surface of the carriage 26 may define one or more forward tabs 50 and one or more rearward tabs 52. See FIG. 2B. The tabs 50, 52 may be arranged to simultaneously be positioned within the receivers 46, 48. In the illustrated embodiment, there are two forward tabs 50 and one rearward tab 52 corresponding to the configuration of the receivers 46, 48. Other arrangements of the tabs 50, 52 may be used depending on the configuration of the receivers 46, 48. Alternatively, the one or more of the tabs may be situated on the baseplate with corresponding receivers in the carriage of the drive plate to receive the tabs.

In the illustrated embodiment, the forward tabs 50 include hooked end portions 54 and the rearward tab 52 includes a hooked end portion 56. As is apparent in FIG. 2B, the hooked end portions 54 extend rearwardly toward the rearward tab 52 and the hooked end portion 56 extends forwardly toward the forward tabs 50.

Figure 3:
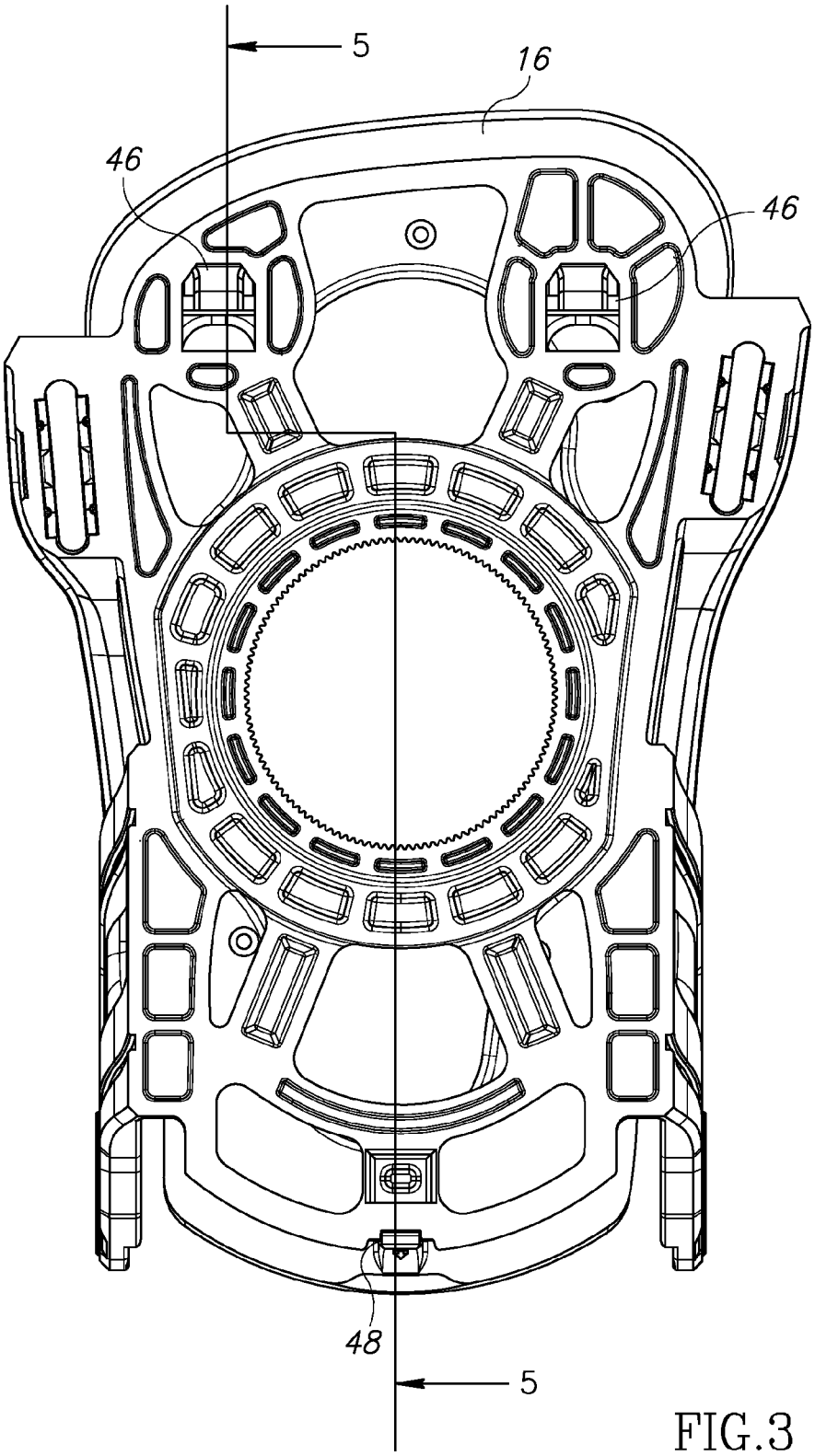
FIG. 3 is a bottom view of a snowboard binding in accordance with an embodiment of the present invention.
Figure 4:
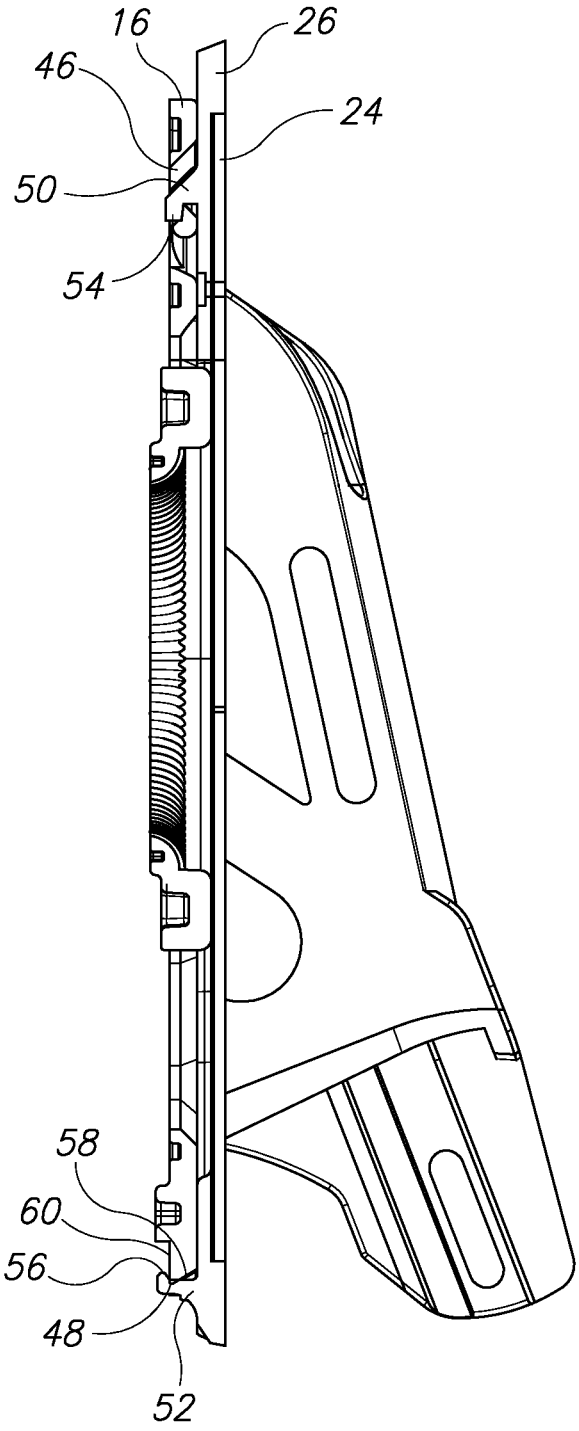
FIG. 4 is a cross-sectional view of a snowboard binding in accordance with an embodiment of the present invention.

The baseplate 16, flex plate 24, and carriage 26 as shown in FIG. 3 may have the cross-sectional configuration shown in FIG. 4. In use, a user may insert the forward tabs 50 into the forward receivers 46 and then press downwardly on the rearward tab 52. The rearward tab 52 may then be pressed against an angled surface 58 of the rearward receiver 48 and be elastically deformed thereby effective to urge the hooked end portion 58 over the angled surface 58. Upon being forced past the angled surface 58, the rearward tab 52 rebounds from being deformed such that the hooked end portion 58 now extends below a lower surface 60 of the baseplate 16. Accordingly, the baseplate 16 is captured between the forward tabs 50 and rearward tab 52 and the hooked end portions 54, 56 thereof in order to secure the drive plate to the baseplate 16.

The amount of securement force or strength provided by the tabs 46, 48 in engagement with the receivers 46, 48 need only be sufficient to secure the drive plate to the baseplate 16 during transportation inasmuch as the pressure of a wearer's boot on the drive plate during use will prevent disengagement.

Various alternative means may be used to secure the carriage 26 to the baseplate 16. For example, only one of the forward and rearward tabs 50, 52 may be used and the other of the forward and rearward tabs 50, 52 may be replaced with a screw passing through the carriage 26 or flex plate 24 and threadably engaging the baseplate 16.

In an alternate embodiment, the carriage and flex plate are an integrated member. Such a drive plate may be constructed of fiberglass infused plastic molded into the drive plate unit. Other materials may alternatively be used.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A snowboard binding comprising:

a baseplate having an upper surface and a lower surface opposite the upper surface, the baseplate configured to secure to an upper surface of a snowboard, the baseplate having the lower surface facing the upper surface of the snowboard;

a boot engagement member secured to the baseplate and configured to secure the boot to the snowboard binding;

a drive plate secured to the baseplate and having a stiffness effective to change the flex properties of the binding, the drive plate further comprising a flex plate and a carriage, the carriage having a plurality of first fastening elements configured to mount the carriage to the baseplate and a plurality of second fastening elements configured to mount the carriage to the flex plate.

2. The snowboard binding of claim 1, wherein the carriage defines a recess on a first surface thereof and a plurality of tabs protruding from a second surface of the carriage opposite the first surface.

3. The snowboard binding of claim 2, wherein the baseplate defines a plurality of tab receivers each positioned to receive one of the tabs of the plurality of tabs.

4. The snowboard binding of claim 3, wherein the plurality of tabs further comprise:

one or more first tabs each including a first hooked end portion extending in a first direction; and one or more second tabs including a second hooked end portion extending in a second direction opposite the first direction.

5. The snowboard binding of claim 4, wherein the first hooked end portion of each of the one or more first tabs extends toward the one or more second tabs.

6. A snowboard binding comprising:

a baseplate having an upper surface and a lower surface opposite the upper surface, the baseplate configured to secure to an upper surface of a snowboard, the baseplate having the lower surface facing the upper surface of the snowboard;

a boot engagement member secured to the baseplate and configured to secure the boot to the snowboard binding;

a drive plate secured to the baseplate and having a stiffness effective to change the flex properties of the binding, wherein the drive plate includes a laminate including one or more composite or metallic material layers.

7. A snowboard binding comprising:

a baseplate having an upper surface and a lower surface opposite the upper surface, the baseplate configured to secure to an upper surface of a snowboard, the baseplate having the lower surface facing the upper surface of the snowboard;

a boot engagement member secured to the baseplate and configured to secure the boot to the snowboard binding; and a drive plate secured to the baseplate and having a stiffness effective to change the flex properties of the binding, wherein the baseplate includes a circular opening with a toothed perimeter, the drive plate occluding the circular opening.

8. The snowboard binding of claim 7, wherein the boot engagement member further comprises a highback and at least one strap configured to secure the boot to the baseplate, wherein the baseplate includes two flanges extending outwardly from the upper surface, the highback and the at least one strap being mounted to the flanges and the baseplate being positioned between the flanges.

9. An apparatus for use with a snowboard binding, the snowboard binding including (a) a baseplate having an upper surface and a lower surface opposite the upper surface, the baseplate configured to secure to an upper surface of a snowboard, the baseplate having the lower surface facing the upper surface of the snowboard and (b) a boot engagement member secured to the baseplate and configured to secure the boot to the snowboard binding, the apparatus comprising:

a drive plate secured to the baseplate and having a stiffness effective to change ride properties of the binding and snowboard, wherein the drive plate is one of a plurality of drive plates each having a different stiffness effective to change the ride properties of the snowboard differently from the other drive plates of the plurality of drive plates; and a plurality of first fastening elements configured to mount the drive plate to the baseplate.

10. An apparatus for use with a snowboard binding, the snowboard binding including (a) a baseplate having an upper surface and a lower surface opposite the upper surface, the baseplate configured to secure to an upper surface of a snowboard, the baseplate having the lower surface facing the upper surface of the snowboard and (b) a boot engagement member secured to the baseplate and configured to secure the boot to the snowboard binding, the apparatus comprising:

a drive plate secured to the baseplate and having a stiffness effective to change ride properties of the binding and snowboard, wherein the drive plate comprises a receiver that includes a recess on a first surface thereof and a plurality of tabs protruding from a second surface of the drive plate receiver opposite the first surface; and a plurality of first fastening elements configured to mount the drive plate to the baseplate.

11. The apparatus of claim 10, wherein the baseplate defines a plurality of tab receivers each positioned to receive one of the tabs of the plurality of tabs.

12. The apparatus of claim 11, wherein the plurality of tabs further comprise:

one or more first tabs each including a first hooked end portion extending in a first direction; and one or more second tabs including a second hooked end portion extending in a second direction opposite the first direction.

13. The apparatus of claim 12, wherein the first hooked end portion of each of the one or more first tabs extends toward the one or more second tabs.

14. The apparatus of claim 9, wherein the drive plate includes a laminate including one or more composite layers.

15. The apparatus of claim 14, wherein the one or more composite layers include at least one of fiberglass, carbon fiber, and metal.

* * * * *